US005086986A

United States Patent [19]

Twente

[11] Patent Number: 5,086,986

[45] Date of Patent: Feb. 11, 1992

[54] APPARATUS FOR SEVERING A WEB AT A REVERSING WINDER

[75] Inventor: Manfred Twente, Tecklenburg, Fed. Rep. of Germany

[73] Assignee: Windmoller & Holscher, Lengerich, Fed. Rep. of Germany

[21] Appl. No.: 543,883

[22] Filed: Jun. 27, 1990

[30] Foreign Application Priority Data

Jul. 6, 1989 [DE] Fed. Rep. of Germany ..... 3922253

[51] Int. Cl.[5] ..... B65H 19/20

[52] U.S. Cl. ..... 242/56 R; 242/56 A; 83/949

[58] Field of Search ..... 242/56 A, 56 R; 83/949

[56] References Cited

U.S. PATENT DOCUMENTS

| | | | |
|---|---|---|---|
| 2,942,796 | 6/1960 | Gurney et al. | 242/56 A |
| 3,592,403 | 7/1971 | Schmitt | 242/56 R |
| 3,841,577 | 10/1974 | Phelps et al. | 242/56 A |
| 4,171,780 | 10/1979 | Bugnone | 242/56 A |
| 4,529,141 | 7/1985 | McClenathan | 242/56 A |
| 4,715,552 | 12/1987 | Matsumoto | 242/56 A |
| 4,919,352 | 4/1990 | Terp et al. | 242/56 R |

FOREIGN PATENT DOCUMENTS

| | | |
|---|---|---|
| 0167715 | 1/1986 | European Pat. Off. . |
| 3204049 | 9/1983 | Fed. Rep. of Germany . |
| 3629216 | 3/1988 | Fed. Rep. of Germany . |

*Primary Examiner*—Daniel P. Stodola
*Assistant Examiner*—John Q. Nguyen
*Attorney, Agent, or Firm*—Fleit, Jacobson, Cohn, Price, Holman & Stern

[57] ABSTRACT

An apparatus for severing a web at a reversing winder comprises a cutter bar provided with a cutter blade and a roller engageable with a currently empty core tube in the winder. It is desired to provide such an apparatus which can be used in conjunction with core tubes having different diameters. This is accomplished by mounting the cutter bar carrying the cutter blade and the roller in such a manner on a traversing frame, which is movable relative to the core tubes, that the position of the cutter bar and of the roller relative to the core tubes is adjustable by a movement of the traversing frame.

8 Claims, 3 Drawing Sheets

APPARATUS FOR SEVERING A WEB AT A REVERSING WINDER

BACKGROUND OF THE INVENTION

1. Field of the Invention

This invention relates to an apparatus for severing a web at a reversing winder, comprising a cutter bar provided with a cutter blade and pressure-applying means which are engageable with a core tube currently in the winder.

2. Description of Prior Art

Reversing winders are provided, as a rule, with two core tubes, one of which is in a winding position at a time. When a complete coil has been wound, the core tube on which the web has been wound is pivotally moved from the winding position to a delivery position and an empty core tube is moved to the winding position at the same time. The web remains connected to the coil during the pivotal movement of the empty and coil-carrying core tubes. Only when the coil-carrying core tube has been moved to the delivery position and the empty core tube has been moved to the winding position is the web severed by means of a cutter blade and the leading end of the incoming web connected to the empty core tube so that a new coil can be wound on the empty tube.

U.S. Pat. No. 2,942,796 discloses an apparatus which is of the kind described first hereinbefore and in which the operations by which the web is severed by means of a cutter blade and the leading end of the incoming web is connected to the still empty core tube, which has been moved to the winding position, are performed at the same time. For the connection to the leading end of the incoming web, the empty core tube is provided with an adhesive tape, at which the leading end of the incoming web is forced against the core tube by means of a sheet metal element which is disposed closely below the cutter blade. For this purpose, the pressure-applying plate is pivotally moved in unison with the cutter blade and severs the web closely beside the empty core tube which has been pivotally moved to the winding position.

Such an apparatus will operate satisfactorily if core tubes are used which have a uniform diameter. On the other hand, if core tubes are used which are larger in diameter than other core tubes, the cutter blade will strike against the core tube as the cutter blade arrives in the severing position. For this reason , this known apparatus cannot be used with core tubes which differ in diameter.

SUMMARY OF THE INVENTION

It is an object of the invention so to improve the apparatus which is of the kind described above and which serves to sever a web at a reversing winder so that the apparatus can automatically be adjusted for use with core tubes which differ in diameter.

This object is accomplished in accordance with the invention in that the cutter bar carrying the cutter blade and the pressure-applying means are mounted in such a manner on a traversing frame, which is movable relative to the core tubes, that the position of the cutter bar and of the pressure-applying means relative to the core tubes is adjustable by a movement of the traversing frame. As a result, the cutter bar, which carries the cutter blade, and the pressure-applying means, can be adjusted relative to the core tubes at the same time by a movement of the traversing frame.

The traversing frame may simply consist of a cross beam and laterally disposed bearing plates. The cross beam may carry movable rollers, which are in a track rail, which is fixed to a main frame. The traversing frame may desirably be movable by means of at least one piston-cylinder unit.

In accordance with a particularly preferred feature of the invention the cutter blade is movable into engagement with the empty core tube by at least one piston-cylinder unit. In this embodiment of the invention that part of the apparatus which comprises the cutter bar, the associated piston-cylinder unit and optionally the means for guiding the cutter bar is rotatably mounted by means of pins in bearing plates of the traversing frame, levers are provided, which are non-rotatably connected to the free end of the pins, and cam followers are carried by the levers at their free ends. The cam followers are guided along oblique camming surfaces of tracks, which are rigid with the main frame in such a manner that the cutter bar will be pivotally moved about the pins to a position which depends on the position of the traversing frame. This will permit a particularly simple adjustment of the cutter blade which is mounted on the cutter bar to a position which matches the diameter of the core tube.

To ensure that the cam followers mounted on the levers will engage the oblique camming surfaces of the tracks which are fixed to the main frame, a further desirable feature resides in that links are non-rotatably connected to the pins and are biased by tension springs for always urging the cam followers against the oblique camming surfaces.

The pressure-applying means desirably comprises a pressure-applying roller for guiding the web. This roller may be movable into engagement with the core tube by at least one piston-cylinder unit, and the piston-cylinder unit or units may be fixed to the movable cross beam. The pressure-applying means may also be displaceably mounted by means of rollers in the track rail which is fixed to main frame.

During the pivotal movement of the core tube on which a complete coil has been wound and of the empty core tube, a contact of the web with the empty core tube, which is coated with adhesive, should be prevented. This may be accomplished by the provision of a deflecting roller, which succeeds the pressure-applying roller.

DETAILED DESCRIPTION OF THE PREFERRED EMBODIMENT

Figure 1:
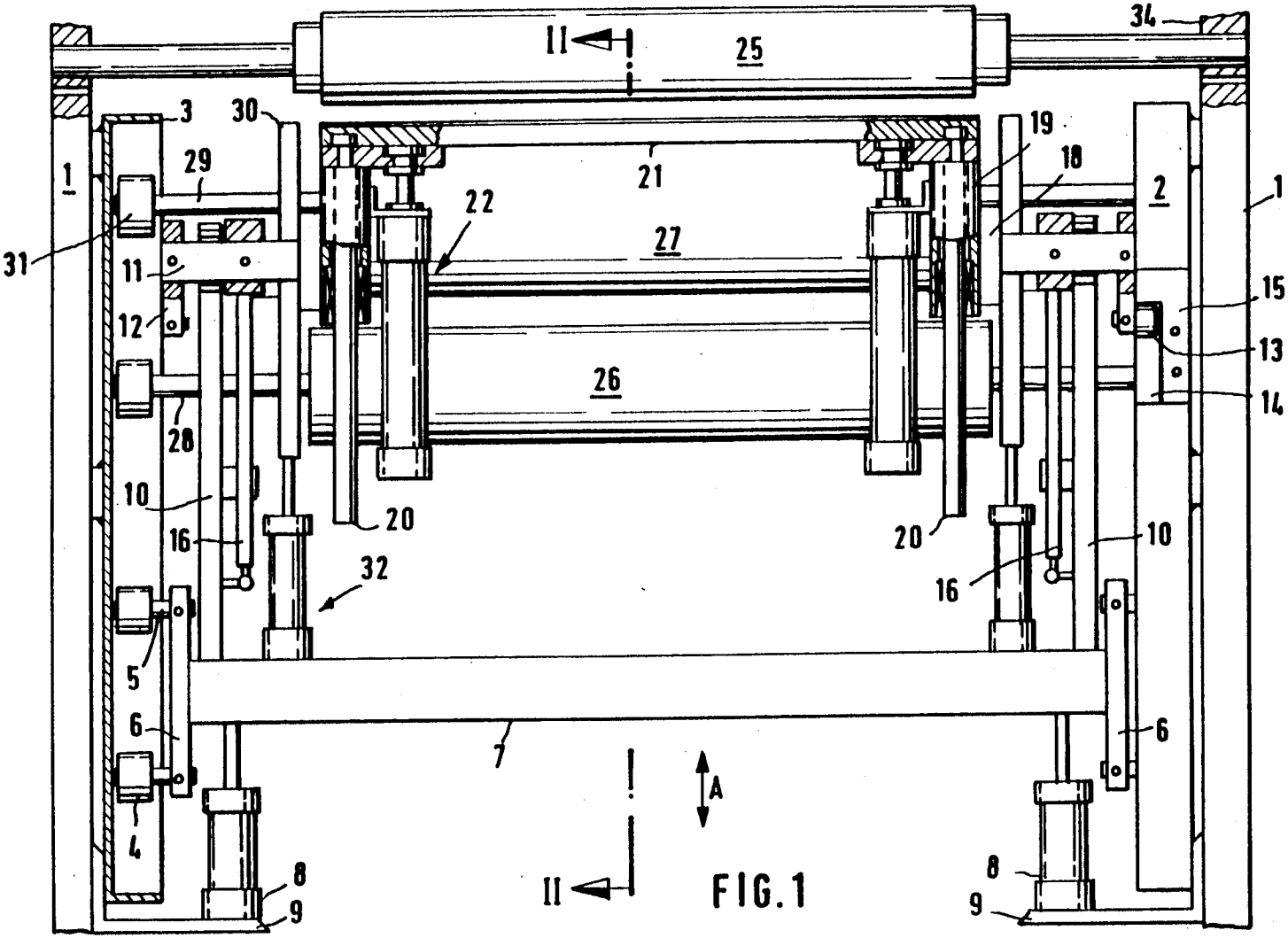
FIG. 1 is a top plan view showing the means for severing the web and for applying the web to a core tube in a reversing winder.

Further details and advantages of the invention will become apparent from the following detailed description of an embodiment shown in the drawing.

Track rails 2 and 3 are secured on the inside to the two side frames or side walls 1 of a reversing winder. The trackf rail 2 is shown in a top plan view on the right in FIG. 1. The track rail 3 is shown in section on the left in FIG. 1. Rollers 4 run in the track rails and are connected by pins 5 to plates 6, which on their inside surfaces are welded to a cross beam 7. Piston-cylinder units 8 are connected at one end to the cross beam 7 and at the other end are secured by angle brackets 9 to the side walls or side frames 1. The piston-cylinder units 8 are operable to reciprocate the cross beam 7 in the directions indicated by the arrow A.

Figure 2:
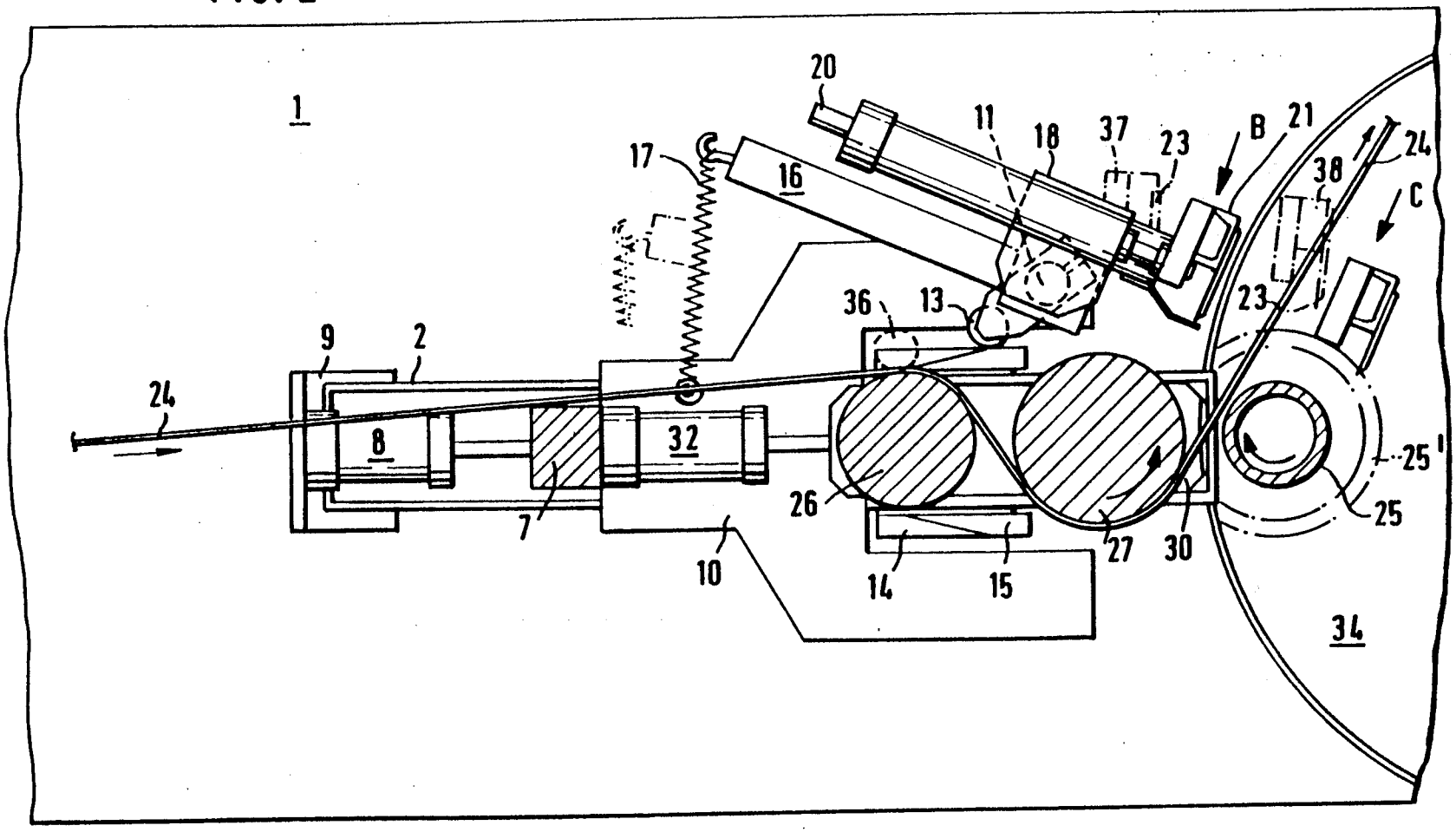
FIG. 2 is a sectional view taken on line II—II in FIG. 1 and showing the severing means and the means for applying the web to the core tube.
Figure 3:
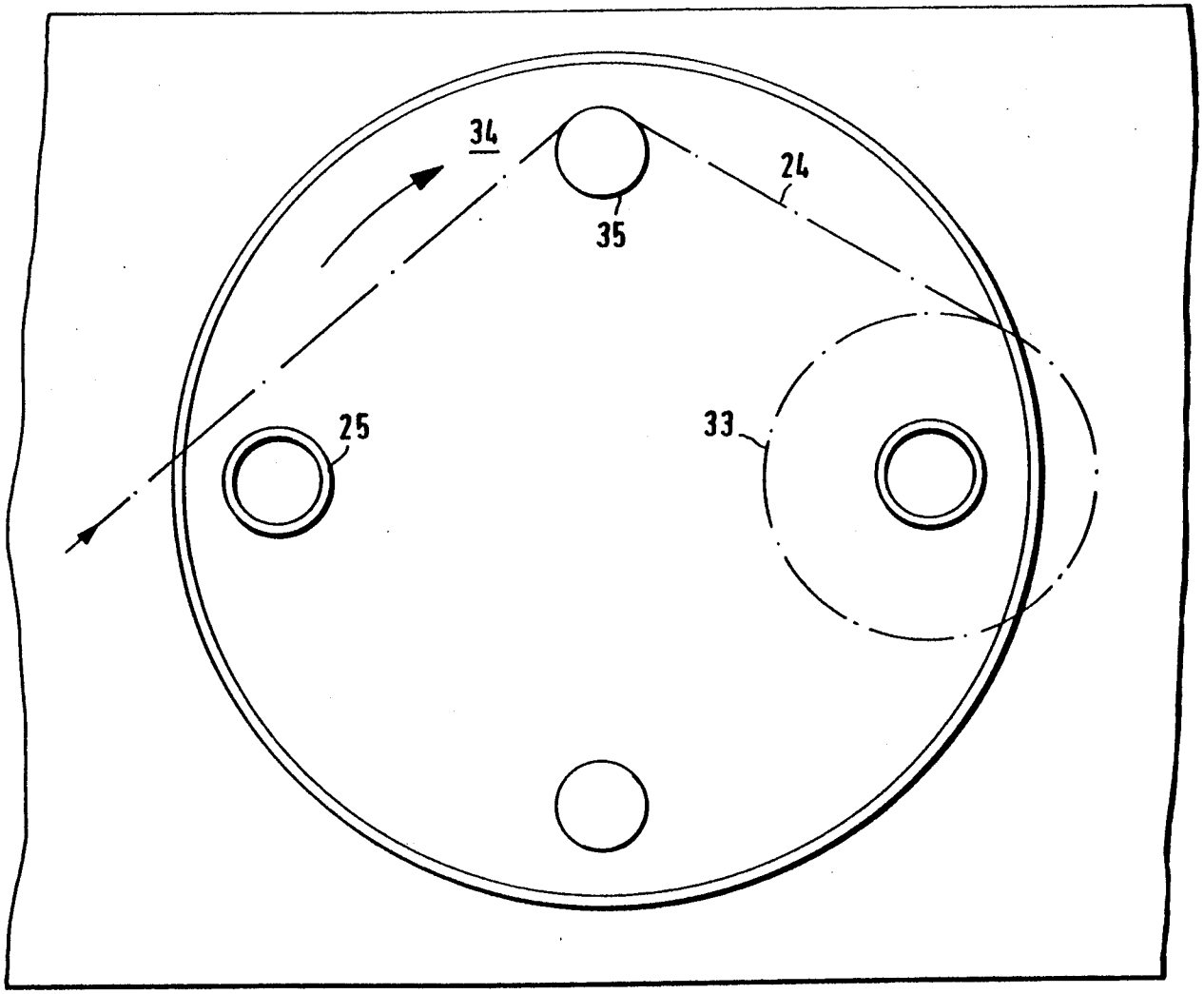
FIG. 3 shows a part of the severing means of a winder comprising a reversing disk and two winding stations.

Bearing plates 10 are fixedly welded to the cross beam 7 adjacent to the plates 6 and, as is shown in FIG. 2, have forked forward end portions. Pins 11 are freely rotatably mounted in the upper portions of the plates 10 at the ends which are remote from the cross beam 7. The pins 11 have protruding outer end portions, which are provided with clamped-on levers 12. Each of said levers 12 carries at its free end a cam follower 13. In dependence on the adjusted extent of the stroke of the piston-cylinder units 8 the cam followers 13 roll to a larger or smaller extent on the oblique camming surfaces 14 of tracks 15. In the position shown in the drawing the piston rods of the piston-cylinder units 8 are extended as far as possible so that the cam followers 13 have reached the uppermost portions of the oblique camming surfaces 14 and, as a result, the pins 11 have been pivotally moved in the clockwise sense in FIG. 2.

Links 16 are fixed to the pins 11 and are biased by tension springs 17 for always urging the cam followers 13 against the oblique camming surfaces 14. At the end which is opposite to the lever 12, each pin 11 is fixedly connected by a bracket 18 to a linear ball bearing 19, by which a rod 20 is guided. At their free ends, the rods 20 carry the cutter bar 21. Piston-cylinder units 22 are connected to the linear ball bearings 19 and are operable to move the cutter bar 21 and the cutter blade 23 from the positon indicated at B in FIG. 2 to the position indicated at C in FIG. 2 so that the web 24 will suddenly be severed.

Thereafter, the leading end of the incoming web should reliably be adhesively bonded to the core tube 25, which has been provided with an adhesive layer. This is accomplished in that the movement of the cutter blade 23 against the web 24 is accompanied by a movement by which the rollers 26 and 27 guiding the web 24 are moved toward the core tube 25 until the roller 27 forces the web 24 against the adhesive-coated core tube 25. To that end the axles 28 and 29 on which the rollers 26 and 27 are freely rotatably mounted are non-rotatably secured to holders 30. Rollers 31 are freely rotatably mounted on the free ends of the axles 28 and 29 and roll in the track rails 2 and 3. The holders 30 are connected to the cross beam 7 by means of piston-cylinder units 32, which are operable to move the holders 30 and the rollers 27 relative to the cross beam 7.

The mode of operation of the embodiment which has been described hereinbefore will now be explained. In the drawing a winder is shown in the position which has been assumed when a coil 33 has been wound to the desired diameter. The reversing disk 34 has been pivotally moved to a position in which the second winding station provided with the adhesive-coated core tube 25 is disposed close to the web 24. The latter is trained around a deflecting roller 35 and does not yet contact the core tube 25 provided with a glue strip. In that position of the winder the rollers 26 and 27 are in the illustrated position and the cutter blade is in the position indicated at B. The piston-cylinder units 22 and 32 are then operated at the same time so that the cutter blade is displaced from the position indicated at B to the position indicated at C and thus severs the web 24. The roller 27 then forces the leading end of the succeeding web 24 against the adhesive-coated core tube 25, on which a new coil can then be wound. When the leading end of the succeeding web 24 has thus been stuck to the core tube 25, the piston-cylinder units 22 and 32 are retracted and the piston-cylinder units 8 are actuated at the same time to move by means of the cross beam 7 the entire cutting means away from the core tube 25 so that the cutting means will not interfere with the winding of a coil and there is sufficient time for the removal of the completely wound coil 33.

It may be desired to use instead of the core tube 25 a core tube which is larger in diameter, e.g., the core tube 25' which is indicated in phantom in FIG. 2. In that case the piston-cylinder units 8 are extended under the control of initiators, not shown, only to such an extent that the cam followers 13 have just moved on the oblique camming surfaces 14 to the position indicated in phantom at 36 in FIG. 2. It is apparent that for the use of the largest possible core tube 25' the pins 11 have not been rotated in a clockwise sense. When the cam followers 13 are in the position indicated at 36, the cutter bar 21 and the associated cutter blade 23 will assume the position indicated at 37. The position to which the cutter bar 21 is extended from the position indicated at 37 is indicated at 38. It is apparent that the web is again severed close to the core tube 25' which is employed.

It will not be necessary for that purpose to readjust the stroke of the piston-cylinder units 32 because said units are pneumatic units which will extend their piston rods until the roller 27 engages the core tube which has been mounted, whether this is the core tube 25 or the core tube 25'.

I claim:

1. An apparatus for severing a web at a reversing winder, comprising:

a cutter bar provided with a cutter blade;

pressure-applying means engageable with an empty core tube in the winder;

a traversing frame on which the cutter bar provided with the cutter blade and the pressure-applying means are mounted, said traversing frame being movable relative to the core tube so that the position of the cutter bar and of the pressure-applying means relative to the core tube is adjustable by a movement of the traversing frame;

a piston-cylinder unit for moving the cutter bar into engagement with the web;

pins connected to said cutter bar, the pins being mounted rotatably in bearing plates of the traversing frame;

levers non-rotatably connected to ends of the pins;

cam followers carried at free ends of said levers, which, in dependence on the position of the traversing frame, are moved on oblique camming surfaces of tracks fixed to a main frame, so that a pivotal movement of said levers and pins is imparted to the cutter bar to an extent which depends on the position of the traversing frame to position the cutter bar in accordance with the diameter of the core tube.

2. An apparatus according to claim 1, characterized in that the traversing frame consists of a cross beam and said bearing plates and the cross beam carries rollers which are movable on track rails, which are fixed to said main frame.

3. An apparatus according to claim 1, characterized in that the traversing frame is movable by means of at least one piston-cylinder unit.

4. An apparatus according to claim 1, characterized in that links are non-rotatably connected to the pins and are biased by tension springs for always urging the cam followers against the oblique camming surfaces.

5. An apparatus according to claim 1, characterized in that the pressure-applying means comprise a pressure-applying roller for guiding the web.

6. An apparatus according to claim 5, characterized in that the pressure-applying roller is operable by at least one piston-cylinder unit.

7. An apparatus according to claim 5, characterized in that the pressure-applying means are provided with rollers, which are movable on track rails, which are fixed to the frame.

8. An apparatus according to claim 5, characterized in that the pressure-applying roller is succeeded by a deflecting roller, which is adapted to prevent a contact between an empty core tube in winding position and a web which is trained around said deflecting roller.

* * * * *